US008614548B2

(12) United States Patent
Huffer

(10) Patent No.: US 8,614,548 B2
(45) Date of Patent: Dec. 24, 2013

(54) ELECTROLUMINESCENT DISPLAY AND METHOD FOR PRODUCTION

(75) Inventor: Scott Huffer, Hartsville, SC (US)

(73) Assignee: Sonoco Development Incorporated, Charlotte, NC (US)

( * ) Notice: Subject to any disclaimer, the term of this patent is extended or adjusted under 35 U.S.C. 154(b) by 99 days.

(21) Appl. No.: 13/353,867

(22) Filed: Jan. 19, 2012

(65) Prior Publication Data

US 2013/0187539 A1 Jul. 25, 2013

(51) Int. Cl.
*H05B 33/00* (2006.01)

(52) U.S. Cl.
USPC ..... 313/509; 313/506

(58) Field of Classification Search
None
See application file for complete search history.

(56) References Cited

U.S. PATENT DOCUMENTS

| | | | | |
|---|---|---|---|---|
| 6,833,669 | B2 | 12/2004 | George et al. | |
| 2001/0035716 | A1 | 11/2001 | Murasko | |
| 2004/0018382 | A1 | 1/2004 | Kinlen | |
| 2006/0269744 | A1 | 11/2006 | Murasko et al. | |
| 2008/0067931 | A1* | 3/2008 | Ito et al. | 313/506 |
| 2009/0080177 | A1 | 3/2009 | Richman | |
| 2009/0154152 | A1 | 6/2009 | Hoch et al. | |

FOREIGN PATENT DOCUMENTS

| | | | |
|---|---|---|---|
| CN | 2368752 | Y | 3/2000 |
| DE | 19 30 863 | A1 | 1/1971 |
| DE | 198 02 269 | A1 | 10/1998 |
| EP | 0357443 | A2 | 3/1990 |
| JP | 8-126514 | A | 5/1996 |
| WO | WO 00/72638 | A1 | 11/2000 |

OTHER PUBLICATIONS

Wonder How to website—How to Make a flexible aluminum electroluminescent display. http://www.wonderhowto.com/how-to-make-flexible-aluminum-electroluminescent-disp.... Printed Oct. 24, 2011.

Electroluminescent Manufacturer—Flatlite El lamps, panels, and strips website—Easy Solutions! We'll Help You Save Time and Money If Your Product Requires Illumination, Flatlite (registered) The world's widest, thinnest, longest light bulb (trademark). All content Copyright 2004-2005. http://www.e-lite.com/ Printed Oct. 24, 2011.

Wireless electricity enables next generation of annoying packaging—Hack a Day website—posted Jan. 28th 2011 3:00pm by Mike Szczys filed under: wireless hacks. http://hackaday.com/2011/0128/wireless-electricity-enables-next-generation-of-annoying... Printed Oct. 24, 2011.

Learn to Make Electroluminescent Clothing KQED QUEST website- Post on Aug 16, 2011 by Laura Khalil from Quest Northern California, Topics: Engineering. http://science.kqed.org/quest/2011/08/16/learn-to-make-electroluminescent-clothing/ Printed Oct. 24, 2011.

PCT International Search Report dated Jun. 5, 2013 issued in related PCT International Application No. PCT/ US2013/021007; Our Ref. No. 29958/09003-PCT.

PCT Written Opinion dated Jun. 5, 2013 issued in related PCT International Application No. PCT/US2013/021007; Our Ref. No. 29958/09003-PCT.

* cited by examiner

*Primary Examiner* — Ashok Patel
(74) *Attorney, Agent, or Firm* — Nelson Mullins Riley & Scarborough LLP

(57) ABSTRACT

The present invention relates to an electroluminescent display. The display includes a front conductive layer, a first dielectric layer, a light emitting layer, a second dielectric layer, and a rear conductive layer. The rear conductive layer defines a continuous void, where the void separates the rear conductive layer into a first area to be energized to electroluminate and a second area that is not energized.

11 Claims, 5 Drawing Sheets

ELECTROLUMINESCENT DISPLAY AND METHOD FOR PRODUCTION

FIELD OF THE INVENTION

The present invention relates generally to electroluminescent displays, and more particularly to localized electroluminescent displays that effectively utilize energy for illumination.

BACKGROUND OF THE INVENTION

Electroluminescent panels or lamps provide illumination for a wide array of objects such as watches, vehicle instrument panels, computer monitors, etc. These electroluminescent panels may be formed by positioning an electroluminescent material between two electrodes. The electric field created when applying an electric current to the electrodes causes excitation of the electroluminescent material and emission of light therefrom.

SUMMARY OF THE INVENTION

According to an aspect, the present invention provides an electroluminescent display that includes a front conductive layer; a first dielectric layer; a light emitting layer; a second dielectric layer; and a rear conductive layer defining a continuous void, where the continuous void separates the rear conductive layer into a first area to be energized for electroillumination and a second area that is not energized.

According to another aspect, the present invention provides a method for the production of an electroluminescent display including layering materials in the following order: a front conductive layer; a first dielectric layer; a light emitting layer; a second dielectric layer; and a rear conductive layer. The method further includes removing a portion of the rear conductive layer such that two distinct sections of the rear conductive layer remain, where a first area of the rear conductive layer forms a part of the electroluminescent display and where a second area of the rear conductive layer is not part of the electroluminescent display.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
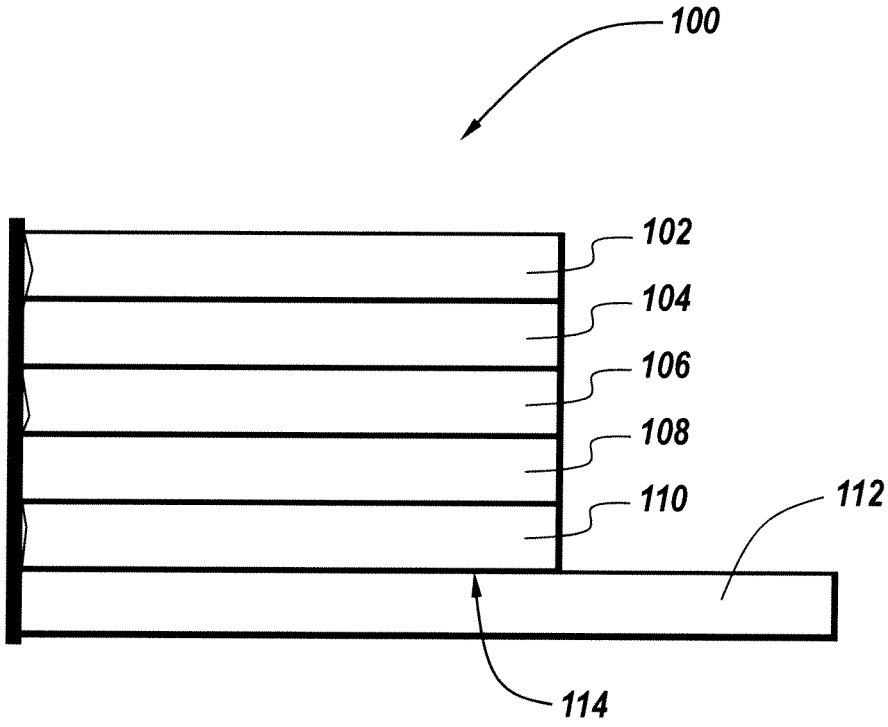
FIG. 1 is an enlarged side view of a electroluminescent display in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to certain embodiments of the invention, one or more examples of which are illustrated in the accompanying drawings. Each example is provided by may of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 5:
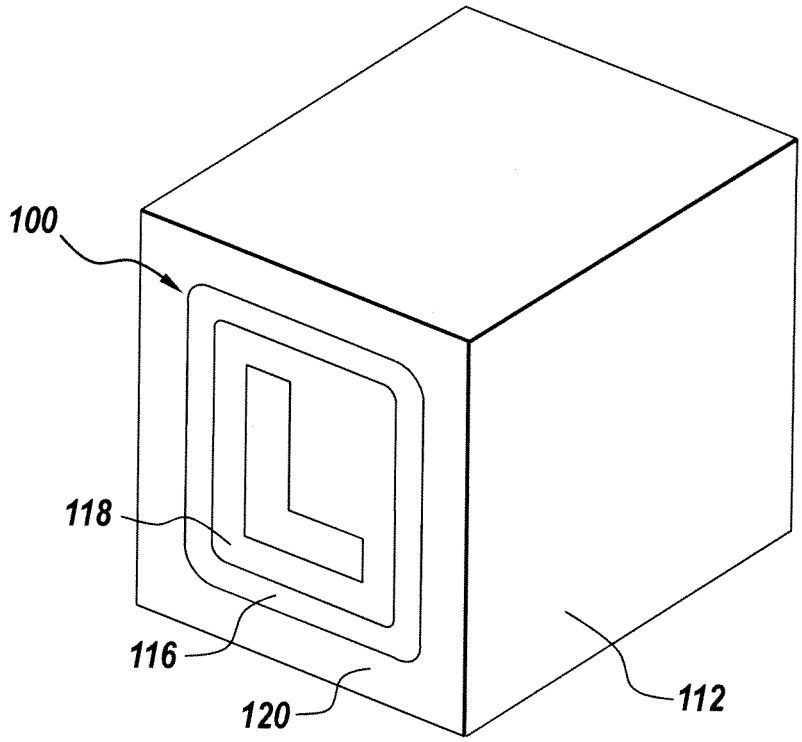
FIG. 5 is a perspective view of packaging materials having an electroluminescent display in accordance with an embodiment of the present invention.

An electroluminescent display 100 in accordance with an embodiment of the present invention is shown in FIGS. 1 and 5. As shown in FIG. 1, electroluminescent display 100 comprises a number of component layers including a conductive front layer 102, a first dielectric layer 104, a light emitting layer 106, a second dielectric layer 108, and a rear conductive layer 110. Utilizing the present invention along with a power source (not shown), electrical energy causes light emitting layer 106 to illuminate and create a desired display.

The electroluminescent display component layers 102-110 may be formed of materials known in the art for use with electroluminescent items. For instance, first and second dielectric layers 104, 108 may be formed of a high dielectric constant material, such as barium titanate. Light emitting layer 106 may be formed of materials that illuminate upon being positioned and/or energized in an electric field. Such materials may include non-organics, such as phosphor, or organics, such as light emitting polymers. In some embodiments, conductive front layer 102 may be formed of a conductive polymer, such as polyaniline, polypyrrole, or polyethylene-dioxithiophene. Conductive rear layer 110 may be formed of conductive particles, e.g., silver or carbon, dispersed in a polymeric or other binder to form a screen printable ink. In other embodiments, conductive rear layer 110 may be formed of aluminum foil. The exact components of the layers may be modified or chosen based on the results and feature desired or the specifications for engineering the particular characteristics of the electroluminescent display.

Figure 2:
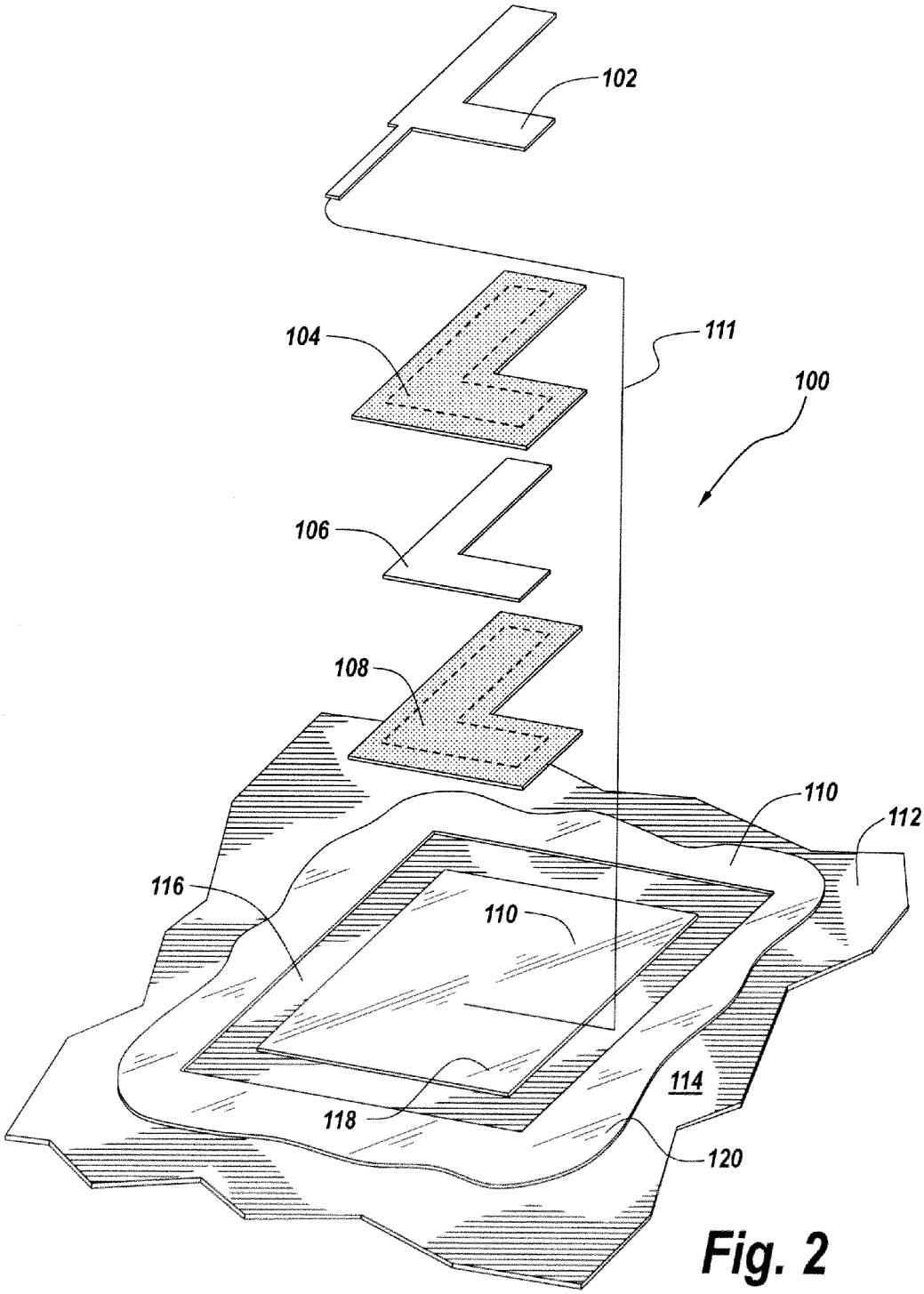
FIG. 2 is an exploded view of the component layers of the electroluminescent display of FIG. 1.

As shown in FIG. 2, the electroluminescent display component layers 102-110 are successively applied to one another with an electrical connection 111 between conductive front layer 102 and conductive rear layer such that electroluminescent display 100 may be illuminated. In addition, in some embodiments and as shown in FIG. 1, electroluminescent display 100 may be applied to a substrate 112 to form a base layer in which the electroluminescent display component layers 102-110 are formed. Substrate 112 may be a packaging material, for instance corrugated fiberboard or paperboard, a fabric or textile material, or other materials known in the art. The user's application of electroluminescent display 100 will dictate the necessary material employed as substrate 112.

Each of the electroluminescent display component layers 102-110 may be successively applied by any means known in the art. For example, component layers may be applied with adhesives or other binding materials or by stenciling, flat coating, brushing, rolling, and spraying. In other embodiments, component layers 102-110 may be printed onto substrate by screen or ink jet printing but the exact means of application will be dictated by the engineering specifications and the processing parameters utilized.

In fabricating the electroluminescent display 100, rear conductive layer 110 may be applied onto a front surface 114 of substrate 112 if a substrate is utilized. Rear conductive layer 110 may be applied generally as a sheet layer covering the entire substrate 112, or may be patterned in a specific arrangement onto front surface 114. Second dielectric layer 108 is then applied over rear conductive layer 110 and may cover any surface based on the specifications of use. Light emitting layer 106 is then applied over second dielectric layer 108. The surface area dimensions of light emitting layer 106 define the illumination area for electroluminescent display 100 and may vary based on the use of and desired characteristics of the electroluminescent display. First dielectric layer 104 is then applied over light emitting layer 106 and, as with second dielectric layer 108, it may cover any surface area based on the specifications of use.

The material chosen for front conductive layer 102 is one that is light-transmissive (i.e. transparent or translucent) such that the illumination provided by light emitting layer 106 may be viewed above electroluminescent display 100 by an observer. In some embodiments, and as indicated above, front conductive layer 102 may be made of polyethylene-dioxithiophene. During fabrication, front conductive layer 102 is applied over first dielectric layer 104. In some embodiments, front conductive layer 102 extends to cover light emitting layer 106 but does not extend beyond the perimeter of either first or second dielectric layers 104, 108. In such an embodiment, front conductive layer 102 works in conjunction with rear conductive layer 110 to provide a relatively consistent electric field across the entire surface of light emitting layer 106 to ensure relatively even illumination of electroluminescent display 100. Once the layers have been properly applied, front conductive layer 102 and rear conductive layer 108 are electrically connected to supply electrical energy to electroluminescent display 100 from a power source (not shown), thereby illuminating light emitting layer 106.

Utilizing the above-described electroluminescent display 100, the present invention further includes a continuous void 116 applied to rear electrode layer 110 as more clearly shown in FIG. 2. Continuous void 116 is located outside of the boundaries of the surface area covered by light emitting layer 106 such that electroluminescent display 100 is localized within a first area 118 of rear conductive layer 110 that will be energized. Continuous void 116 further creates a second area 120 of the rear conductive layer 110 that does not require electrical energy due to the absence of any electroluminescent display 100 in second area 120. Such an arrangement allows for electrical energy to be localized to first area 118, whereby electrical energy is not wasted by providing it to second area 120 where there is no electroluminescent display 100.

Continuous void 116 may be created by any means known in the art. For example, in some embodiments, continuous void 116 may be created by die-cutting rear conductive layer 110. In other embodiments, continuous void 116 may be created by shearing or other forms of cutting. As indicated above, continuous void 116 aids in creating a first area 118 of rear conductive layer 110 that is energized and forms part of the electroluminescent display and a second area 120 that is not energized and which is not part of the electroluminescent display.

In other embodiments contemplated by the present invention, continuous void 116 may be created by the application of a material onto rear conductive layer 110 that interrupts the conductivity of rear electrode layer 110. As such, the material applied to create continuous void 116 would provide the necessary first and second areas 118, 120 as described above.

Figure 3A:
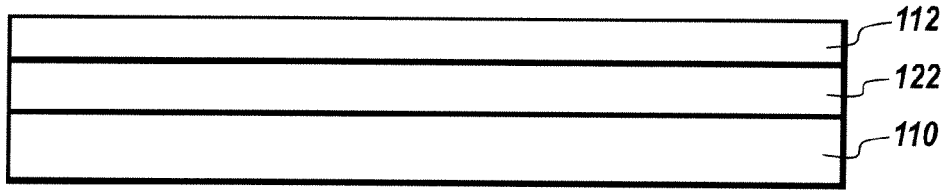
FIG. 3A is an enlarged side view of a rear conductive layer attached to a substrate by an adhesive.
Figure 3B:
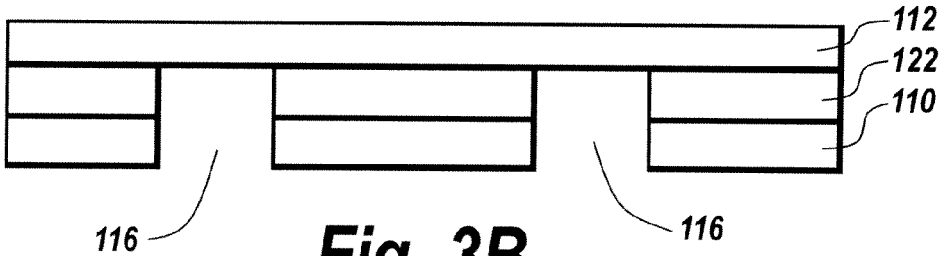
FIG. 3B is an enlarged side view of the rear conductive layer of FIG. 3A defining a continuous void.
Figure 4A:
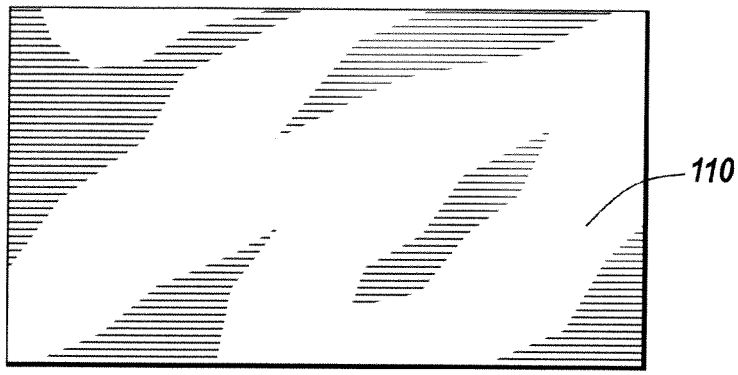
FIG. 4A is a top view of a rear conductive layer of the present invention.
Figure 4B:
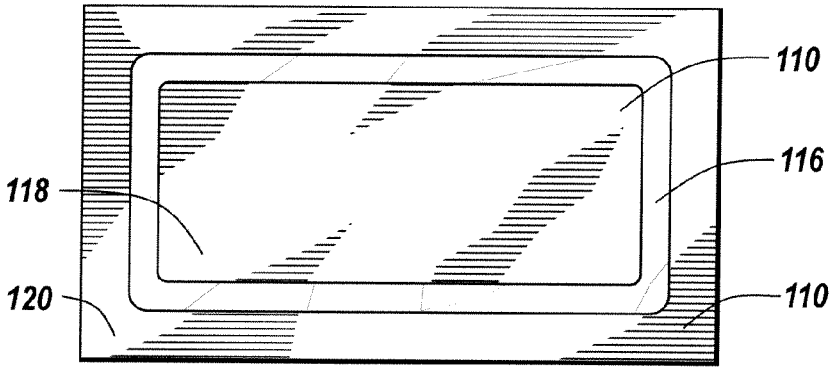
FIG. 4B is a top view of the rear conductive layer of FIG. 4A defining a continuous void.
Figure 4C:
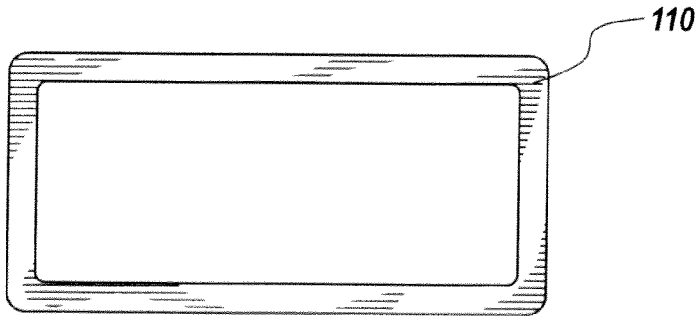
FIG. 4C is a top view of a die-cut portion of the rear conductive layer of FIG. 4A.

An example of the creation of continuous void 116 is illustrated in FIGS. 3A and 3B and FIGS. 4A through 4C. In the representative example shown in the Figures, rear conductive layer 110 is applied to a substrate 112 with the use of adhesive 122 as more clearly shown in FIGS. 3A and 3B. Rear conductive layer 110 is then die-cut resulting in first area 118, which will include electroluminescent display 100, second area 120 and continuous void 116 in between, as shown in FIGS. 3B and 4B. The resulting die-cut piece of rear conductive layer 110, shown in FIG. 4C, may be discarded as it may no longer serve a function with the present invention.

In embodiments of the present invention and as indicated above, rear conductive layer may be formed of aluminum foil, where it is applied to a packaging material substrate as shown in FIG. 5. The selection of aluminum foil may be advantageous in the present invention due to its conductive properties and relatively low costs. In embodiments where aluminum foil in utilized, the use of any form of aluminum foil is contemplated in the present invention. For example, the thickness aluminum foil utilized in the present invention may range from 0.2 s to 8 mils. The user's specifications will dictate the necessary materials utilized as the conductive layer and the substrate to which it is applied.

As indicated above, aluminum foil may be advantageous due to its versatility in connection with the present invention. If the electroluminescent display 100 is utilized on packaging material substrates, aluminum foil may serve multiple purposes. For instance, packaging materials typically require the addition of layers with barrier properties to protect them from certain elements, e.g. liquids, light and others. Utilizing aluminum foil as the rear conductive layer 110 may provide both the desired barrier properties as well as the desired conductive material necessary for creating electroluminescent display 100. In such an embodiment, multiple types of materials are not necessary to perform each of the required functions with the present invention.

In addition, the present invention may aid in the efficient production of such packaging materials with electroluminescent displays. For instance, utilizing the methods of the prior art, an additional step of adhering a localized rear conductive layer on top of an outer packaging layer is necessary for the display. However, utilizing the above described invention, the use of aluminum foil for the electroluminescent display 100 is combined with the addition of the protective or barrier layer, reducing the number of steps necessary for creating the desired packaging materials.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. An electroluminescent display comprising:

a front conductive layer;

a first dielectric layer;

a light emitting layer;

a second dielectric layer; and a rear conductive layer defining a continuous void, wherein the void separates the rear conductive layer into a first area to be energized to electroluminate and a second area that is not energized.

2. The electroluminescent display of claim 1, wherein the rear conductive layer is formed of aluminum foil.

3. The electroluminescent display of claim 1, wherein the continuous void is die-cut from the rear conductive layer.

4. The electroluminescent display of claim 1, wherein the rear conductive layer is applied to a substrate.

5. The electroluminescent display of claim 4, wherein the substrate is a packaging material.

6. The electroluminescent display of claim 5, wherein the packaging material is paperboard.

7. The electroluminescent display of claim 1, wherein the light emitting layer is formed of phosphor.

8. The electroluminescent display of claim 1, wherein the front conductive layer is made of a material that is light-transmissive.

9. An electroluminescent display comprising:

a front conductive layer;

a first dielectric layer;

a phosphor layer a second dielectric layer;

an aluminum foil layer defining a continuous void, wherein the void separates the aluminum foil layer into a first area to be energized to electroluminate and a second area that is not energized; and a paperboard substrate.

10. The electroluminescent display of claim 9, wherein the continuous void is die-cut from the rear conductive layer.

11. The electroluminescent display of claim 9, wherein the front conductive layer is made of a material that is light-transmissive.

* * * * *